US005435102A

United States Patent [19]

McCarthy

[11] Patent Number: 5,435,102

[45] Date of Patent: Jul. 25, 1995

[54] PIVOTABLE MULLION ASSEMBLY

[75] Inventor: Walter McCarthy, Shepherdstown, W. Va.

[73] Assignee: Von Duprin, Inc., Indianapolis, Ind.

[21] Appl. No.: 225,679

[22] Filed: Apr. 11, 1994

[51] Int. Cl.[6] ..... E06B 5/00

[52] U.S. Cl. ..... 49/365

[58] Field of Search ..... 49/365, 366; 160/40, 160/119

[56] References Cited

U.S. PATENT DOCUMENTS

| | | | |
|---|---|---|---|
| 1,258,638 | 3/1918 | Tomkinson et al. | 49/365 X |
| 2,275,729 | 3/1942 | Casse | 49/365 X |
| 2,275,730 | 3/1942 | Casse | 49/365 |
| 3,319,382 | 5/1967 | Hand | 49/365 X |
| 4,327,523 | 5/1982 | Gravely | 49/365 X |
| 5,005,315 | 4/1991 | Jackson, Jr. | 49/365 X |

*Primary Examiner*—Philip C. Kannan

*Attorney, Agent, or Firm*—Robert F. Palermo; A. James Richardson; Craig A. Wood

[57] ABSTRACT

A mullion assembly mountable in a door frame includes a bottom fitting attached to a floor and a top fitting attached to the door frame above the bottom fitting. The top fitting supports a bolt engagement assembly for engaging a lock assembly positioned in a mullion cavity of a mullion. The lock assembly has a bolt extendable from the mullion cavity to engage the bolt engagement assembly supported by the top fitting and hold the mullion in a fixed position. Retraction of the bolt is controlled by a key lock assembly that allows controlled access disengagement of the bolt from the bolt engagement assembly, followed by pivoting movement of the mullion away from its upright position in the door frame.

4 Claims, 3 Drawing Sheets

PIVOTABLE MULLION ASSEMBLY

BACKGROUND AND SUMMARY OF THE INVENTION

The present invention relates to a pivotable mullion assembly for a double door. More particularly, the present invention relates to a pivotable mullion assembly controlled by a key cylinder lock mechanism.

Mullions are vertically oriented doorway inserts that allow use of single doors in double door frames. Conventionally, mullions are centered in a double doorway and attached with screws or bolts to fittings inset into the floor and the top of the door frame. Two strikes are provided on opposing sides of the mullion to accommodate latches of two single size doors that are respectively hinge mounted on opposite side of the door frame.

When unobstructed access through the double door is needed, conventional mullions must be unscrewed or unbolted from the inset fittings. This can be time consuming and difficult procedure, and normally requires two people. One person must hold the mullion while the other person unscrews or unbolts the mullion from the fittings. However, repeated removal and replacement of the mullion can also cause problems, with the fittings tending to become loose with time, or screw threads being stripped or damaged.

To overcome this problem, removable mullions that do not require unscrewing or unbolting have been disclosed. For example, U.S. Pat. No. 2,275,730 discloses a mullion capable of being seated in a floor bracket and swung forward to permit a latch bolt to snap into abutting relation with a tooth, holding the mullion in position against a top bracket. The mullion can be released by an actuating chain that retracts the latch bolt into a housing beneath the tooth, permitting inward tilting and complete removal of the mullion.

Movable mullion assemblies that remain attached to a doorway are also known in the prior art. For example, a pivoting mullion system is described in U.S. Pat. No. 1,258,638 to Tomkinson and Prescott. This mullion system includes a folding mullion that can be lifted out of the doorway using a hoisting chain. The mullion can be lifted straight upward, or alternatively rotated upward about a pivot attached to the top of the doorway.

However, mullion assemblies known in the prior art are disadvantageous for many applications because the mullion release system is not protected against damage or unauthorized removal by vandals. What is needed is an easily pivoted mullion assembly that can be snapped into an upright position to secure hinged doors, does not require multiple persons to remove or align, and is not pivotable or removable by unauthorized persons.

The present invention uses a key controlled lock mechanism to provide such a vandal resistant mullion assembly. A mullion assembly in accordance with the present invention includes a bottom fitting attached to a floor and a top fitting attached to the door frame above the bottom fitting. In preferred embodiments, the bottom fitting includes a pivot pin extending through the mullion cavity to hold the mullion in position, although other attachment mechanisms such as slip bolts, hinges, interlocking flanges, or other conventional pivoting mechanisms can also be employed.

The top fitting supports a bolt engagement assembly that can engage a bolt or other key controlled extendable element. A mullion, defining a mullion cavity therein, is positioned between the bottom fitting and the top fitting, and a lock assembly is positioned in the mullion cavity. The lock assembly includes a casing supporting a bolt and a key cylinder. Rotation of a key in the key cylinder causes alternate extension or retraction of the bolt to respectively engage with or disengage from the bolt engagement assembly of the top fitting. Typically, the bolt engagement assembly is a conventional strike dimensioned to accommodate the bolt and hold the mullion in a fixed position.

In certain embodiments, the bottom fitting of the mullion assembly can optionally include a lock mechanism, such as a screwlock extending between the bottom fitting and the mullion. This provides additional security, since only when the screwlock is disengaged from its connection between the bottom fitting and the mullion is pivoting motion of the mullion permitted.

Further features, objects, and advantages of the present invention will become more apparent upon consideration of the accompanying claims, drawings, and the following description of those drawings.

DETAILED DESCRIPTION OF THE INVENTION

Figure 1:
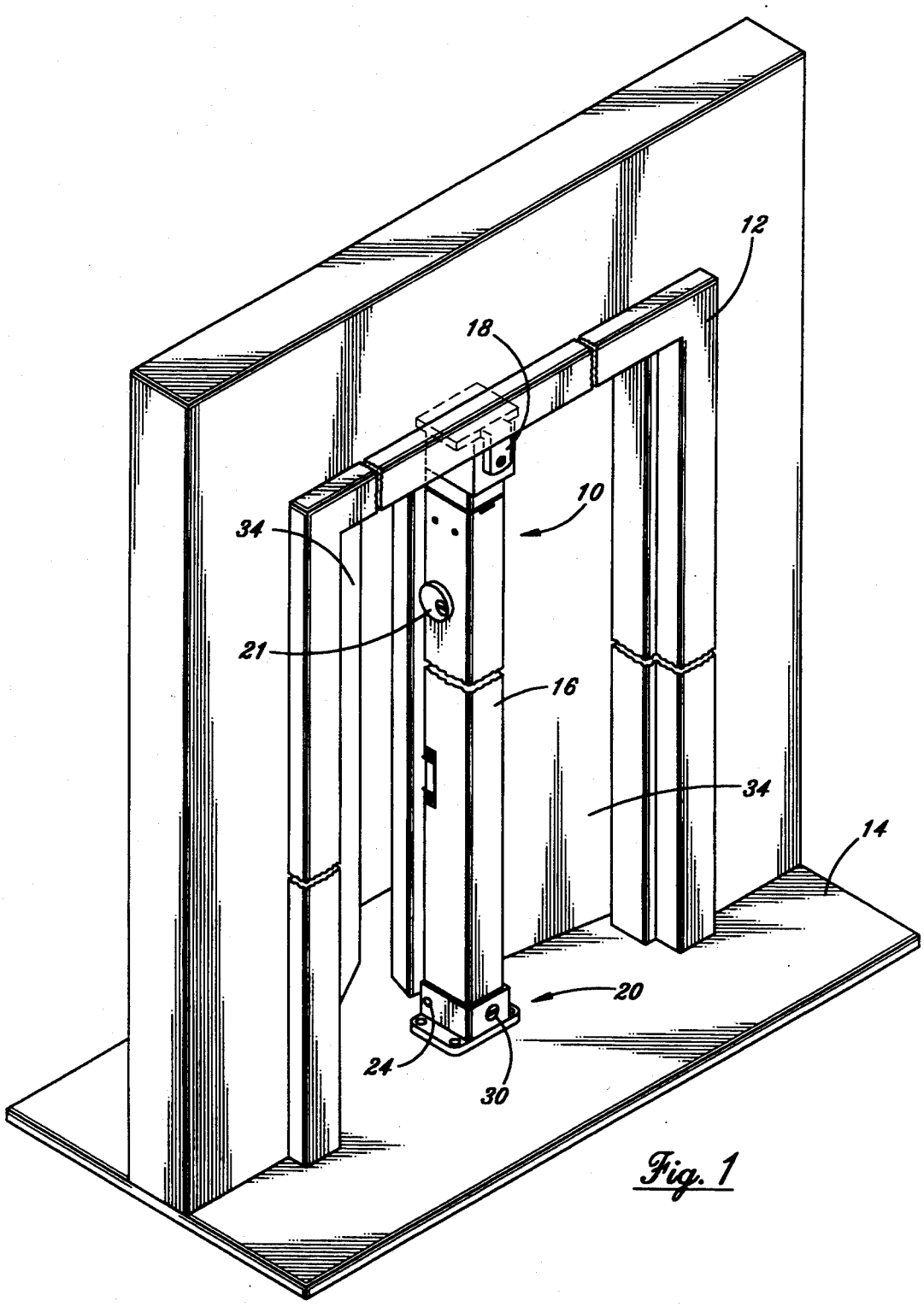
FIG. 1 is a perspective view of a double door frame having a pivotable mullion assembly in accordance with the present invention, the mullion assembly being mounted between top and bottom fittings centered in the door frame.
Figure 3:
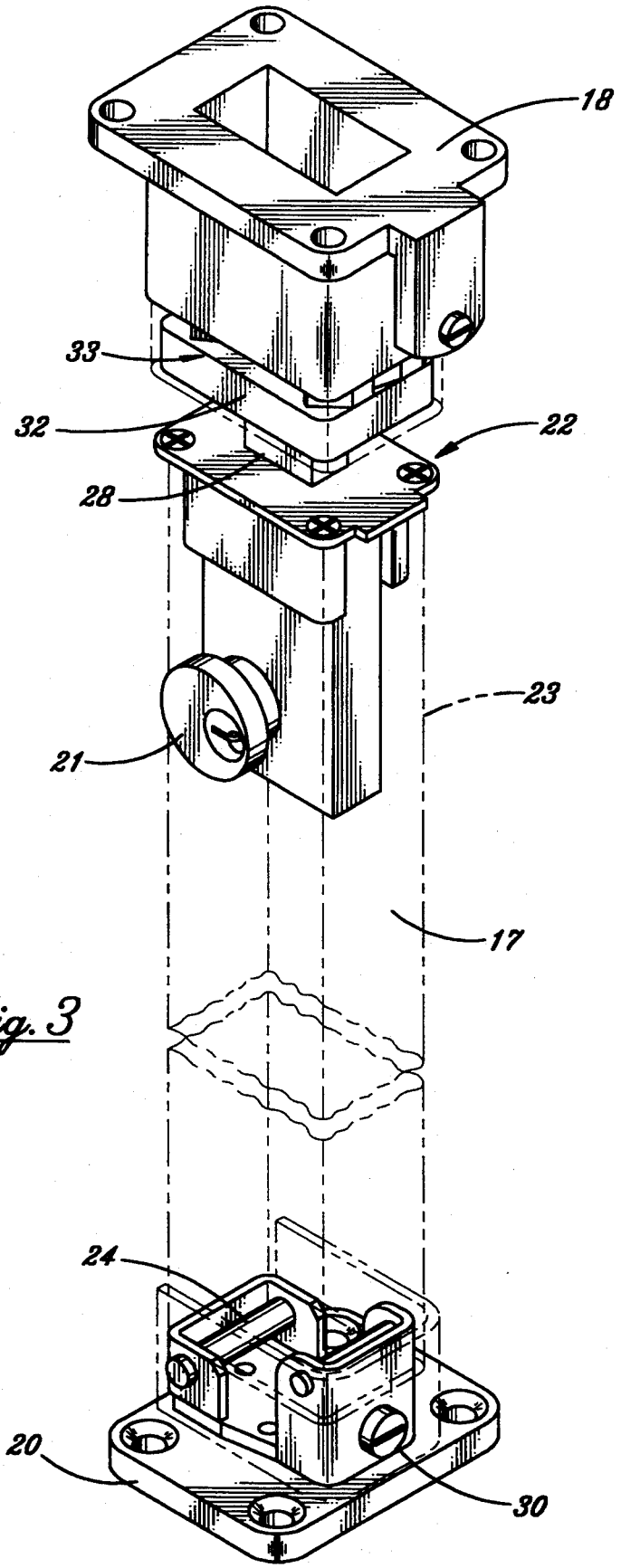
FIG. 3 is an external broken perspective view of the mullion assembly, illustrating top and bottom fittings, and a mortise deadlock assembly that controls disengagement of the mullion from the top fitting.

As shown in FIG. 1, a mullion assembly 10 is installed between a standard double door frame 12 with doors 34 and a floor 14. The mullion assembly 10 includes a mullion 16 for engaging a top fitting 18. The top fitting 18 is permanently attached to the door frame 12, and as best seen in FIG. 3, supports a bolt engagement assembly 33 that includes a strike 32. The strike is of conventional construction, and is dimensioned to accommodate insertion therethrough of a bolt 28.

As best seen in FIG. 3, the mullion 16 defines a mullion cavity 17. The mullion 16 can be constructed from steel or aluminum by conventional techniques such as extrusion, stamping, folding or other known metal working techniques. The cavity 17 is sized to hold lock assembly 22, which includes a casing 23 that supports the extendable and retractable bolt 28. The casing 23 is installed by welding, keying emplacement, bolt attachment, permanent blocks, or any other conventional attachment mechanism.

Extension and retraction of the bolt 28 is controlled by a key lock cylinder 21 (such as conventional mortise deadlocks or similar key controlled, bolt throwing mechanisms) that is also supported by the casing 23. In the particularly preferred embodiment illustrated in the Figures, a mortise deadlock with conventional six or seven pin key cylinder is used. The key lock cylinder 21 is positioned on the mullion to be externally accessible for key release without any special effort by authorized persons.

Figure 2:
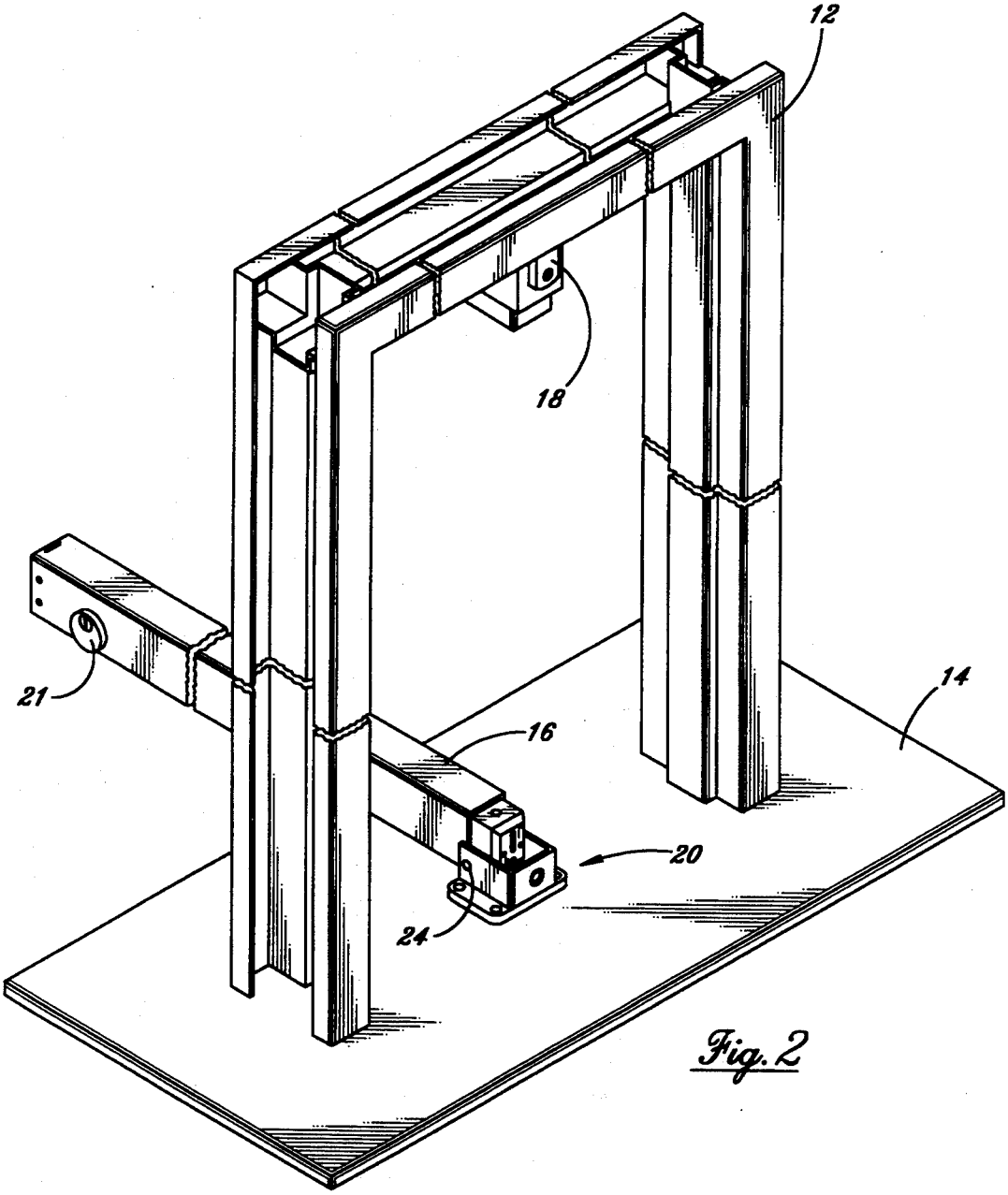
FIG. 2 is a perspective view of the mullion assembly of FIG. 1, the mullion assembly being rotated about a pivot pin connected to the bottom fitting after disengagement of the mullion from the top fitting by key activation of a mortise deadlock assembly.

As best seen with reference to FIG. 2, pivoting release of the mullion 16 from the top fitting 18 follows in response to activation of a key lock cylinder 21. This release is simple and secure, with a key turn causing unlocking of the lock assembly (by retraction of bolt 28 into casing 23), breaking the locked connection between the lock assembly 22 and the bolt engagement assembly 33. After breaking the connection between the lock assembly and the bolt engagement assembly, a screwlock 30 that passes through the bottom fitting to engage the mullion 16 can be unscrewed. As seen in FIG. 2, the mullion 16 can then be pulled forward to break the connection between the mullion 16 and top fitting 18. The mullion 16 can then be pivoted about pivot pin 24, which pivotally connects the mullion 16 to the bottom fitting 20, and manually lowered to the floor. In this position, the mullion allows unimpeded access through the doorway.

As those skilled in the art will appreciate, it is also possible to reverse the pivoting orientation of the mullion by positioning the pivot pin in the top fitting and the bolt engagement assembly in the bottom fitting. If suitable hoists, connectors, chains, or other attachment devices are provided, the mullion can be optionally pivoted upward and held against a ceiling, rather than resting on the floor as shown by the Figures.

Replacement of the mullion 16 in a vertical, upright position is also simple. The mullion 16 is pivoted toward the top fitting 18, and the lock assembly is engaged to extend the bolt 28 into the strike 33 of the bolt engagement assembly 32. The screwlock is then threadedly inserted to engage the bottom fitting and the mullion. The mullion 16 remains locked in position until someone again uses a key to retract the bolt 28.

While the present invention has been described in connection with certain specific embodiments, it should be understood that the specific examples are not intended to limit the invention as set forth in the following claims.

What is claimed is:

1. A mullion assembly mountable in a door frame, the mullion assembly comprising:

a bottom fitting attached to a floor;

a top fitting attached to the door frame above the bottom fitting, the top fitting having a bolt engagement assembly;

a mullion defining a mullion cavity, the mullion being positionable in removable attachment between the bottom fitting and the top fitting;

a lock assembly positioned in the mullion cavity, the lock assembly having a bolt extendable from the mullion cavity to engage the bolt engagement assembly of the top fitting and hold the mullion upright, with bolt movement of the lock assembly controlled by a key lock cylinder to permit key controlled disengagement of the bolt from the bolt engagement assembly, followed by temporary removal of the mullion from its upright position in the door frame; and means for pivotally mounting the mullion to the bottom fitting, the mounting means having a pivot pin extending through the bottom fitting to pivotally engage the mullion.

2. A mullion assembly mountable in a door frame, the mullion assembly comprising:

a bottom fitting attached to a floor;

a top fitting attached to the door frame above the bottom fitting, the top fitting having a bolt engagement assembly;

a mullion defining a mullion cavity, the mullion being positionable in removable attachment between the bottom fitting and the top fitting;

a lock assembly positioned in the mullion cavity, the lock assembly having a bolt extendable from the mullion cavity to engage the bolt engagement assembly of the top fitting and hold the mullion upright, with bolt movement of the lock assembly controlled by a key lock cylinder to permit key controlled disengagement of the bolt from the bolt engagement assembly, followed by temporary removal of the mullion from its upright position in the door frame; and means for engaging the mullion to the bottom fitting, to prevent pivoting motion of the mullion, the engaging means having a screwlock extending between the bottom fitting and the mullion, with disengagement of the screwlock from the mullion permitting pivoting motion of the mullion.

3. A mullion assembly comprising:

a bolt engagement assembly attachable to a door frame;

a mullion positionable within the door frame adjacent to the bolt engagement assembly;

a lock assembly attached to the mullion, the lock assembly having a bolt extendable to engage the bolt engagement assembly and hold the mullion in a fixed and vertical position, with the lock assembly controlled by a key to limit to authorized persons the disengagement of the bolt from the bolt engagement assembly;

a bottom fitting attached to a floor, the bottom fitting having a pivot pin extending therethrough to pivotally engage the mullion; and a top fitting attached to the door frame above the bottom fitting, with the top fitting supporting the bolt engagement assembly.

4. A mullion assembly mountable in a door frame, the mullion assembly comprising:

means for engaging a bolt, the engaging means being attached to the door frame:

a mullion positionable upright in the door frame adjacent to the bolt engagement means;

means for extending a bolt to engage the bolt engaging means and hold the mullion in a fixed position, with the bolt extending means being attached to the mullion;

means for retracting the bolt, the retracting means having a key operated mechanism to disengage the bolt and the bolt engaging means and permit movement of the mullion from its upright position in the door frame;

a bottom fitting attached to a floor, the bottom fitting having a pivot pin extending therethrough to pivotally engage the mullion; and a top fitting attached to the door frame above the bottom fitting, with the top fitting supporting the bolt engagement means.

* * * * *